US007032413B1

(12) United States Patent
Specktor

(10) Patent No.: US 7,032,413 B1
(45) Date of Patent: Apr. 25, 2006

(54) KNITTING NEEDLE SIZING STRUCTURE AND METHOD

(76) Inventor: Denyse Specktor, 4756-4 Telephone Rd., No. 108, Ventura, CA (US) 93003

( * ) Notice: Subject to any disclaimer, the term of this patent is extended or adjusted under 35 U.S.C. 154(b) by 0 days.

(21) Appl. No.: 11/022,532

(22) Filed: Dec. 22, 2004

Related U.S. Application Data

(60) Provisional application No. 60/533,164, filed on Dec. 29, 2003.

(51) Int. Cl.
*D04B 3/00* (2006.01)

(52) U.S. Cl. ..... 66/1 A; 33/555.2

(58) Field of Classification Search ..... 66/1 R, 66/1 A, 116–118; 33/679.1, 555.1, 555.2
See application file for complete search history.

(56) References Cited

U.S. PATENT DOCUMENTS 524,589 A * 8/1894 Gruebel ..... 33/514.1
1,438,681 A * 12/1922 Bath ..... 33/555.2
1,989,353 A * 1/1935 Davis ..... 33/555.2
2,806,286 A * 9/1957 Weiner ..... 33/2 R
4,517,747 A * 5/1985 Morin ..... 33/512
5,353,513 A 10/1994 Round
5,617,644 A * 4/1997 Bonelli ..... 33/548
6,047,606 A * 4/2000 Sibole ..... 73/865.8
6,279,244 B1 8/2001 Kelley
6,481,114 B1 11/2002 Kalajian

* cited by examiner

*Primary Examiner*—Danny Worrell
(74) *Attorney, Agent, or Firm*—O'Connell Law Firm

(57) ABSTRACT

A knitting needle sizing structure and method for determining a diametrical size of a knitting needle with a plurality of knitting needle sizing wands retained by a retaining spindle with a rod with stop members disposed at opposite ends thereof wherein each knitting needle sizing wand has a sizing ring defining a sizing aperture with a measuring size corresponding to a knitting needle diametrical size. The diametrical size of the knitting needle can be determined by comparing the knitting needle diametrical size to the sizing aperture of one or more knitting needle sizing wands. A sizing legend, which can be in the US, Metric, and/or any other sizing convention, can be associated with each knitting needle sizing wand.

17 Claims, 3 Drawing Sheets

KNITTING NEEDLE SIZING STRUCTURE AND METHOD

FIELD OF THE INVENTION

The present invention relates generally to measuring devices. More particularly, disclosed herein is a tool for measuring the size of a knitting needle and a method for using the same.

BACKGROUND OF THE INVENTION

It has been said that the only time knitting gauge is not important is when the knitter does not care whether the garment fits or how it looks. Gauge, therefore, is normally considered the most important aspect to achieving successful results in a knitting project. It effectively determines the size and fit of the garment or other item being made. Gauge can be defined as the number of stitches per inch, referred to as stitch gauge, or the number of rows per inch, referred to as row gauge. For example, where a person seeks to knit a sweater of 40 inches around with a recommended stitch gauge of 4 stitches per inch but the actual gauge is 4½ stitches per inch, the resulting sweater will be roughly 7 inches too small. To avoid such errors, knitters typically ensure that they are knitting to proper gauge by crafting a representative swatch, also often referred to as a gauge, prior to beginning the actual knitting project.

For each type of stitch, row gauge and stitch gauge are determined primarily by the type of yarn and the knitting needle size, more particularly the knitting needle diameter. A larger needle will produce fewer stitches per inch than a smaller needle. Knitting patterns normally indicate the gauge on which the pattern is based using a specified needle size and a recommended yarn.

It will be appreciated, therefore, that knowing the knitting needle size is critical to achieving proper gauge. While some needles bear markings to indicate their size, many do not. As a result, the knitter is left guessing as to the precise size of the needle. Since many needle sizes differ by just one quarter of a millimeter, even experienced knitters find reliably determining the exact size of an unmarked needle difficult.

The prior art has disclosed a number of needle sizing devices. However, most such devices are disadvantageous for a number of reasons. For example, one common arrangement under the prior art comprises a flat panel with a plurality of sizing apertures formed therein. Such structures are relatively bulky and, therefore, are less than ideal in relation to transport, packing, and storage. Furthermore, with as many as seventeen or more apertures on a single board, the structures can become confusing to the user as he or she seeks to determine which size indication corresponds to which aperture. Even further, many prior art devices enable the user only to determine needle size in one sizing convention, such as US only or metric only, while knitting patterns vary in the referenced sizing convention.

In light of the above, it becomes clear that there is a need for a needle sizing structure that provides a solution to the disadvantages from which the prior art has suffered. It is clearer still that a needle sizing structure that accomplishes the foregoing while providing a number of heretofore unrealized advantages would represent a truly useful advance in the art.

SUMMARY OF THE INVENTION

Advantageously, the present invention is founded on the basic object of providing a knitting needle sizing structure and method that overcomes the disadvantages demonstrated by the prior art while providing a number of further advantages thereover.

A more particular object of embodiments of the invention is to provide a needle sizing structure and method that enable a quick and accurate determination of needle size.

A further object of embodiments of the invention is to provide a needle sizing structure that is compact in size.

In particular embodiments of the invention, a still further object is to provide a needle sizing structure and method that enable needle size determination under multiple sizing conventions.

A related object of embodiments of the invention is to provide a needle sizing structure and method that facilitate a conversion of needle sizes between sizing conventions.

A resultant object of the invention is to provide a needle sizing structure and method that enable a knitter to achieve proper gauge efficiently and effectively.

These and further objects and advantages of embodiments of the invention will become obvious not only to one who reviews the present specification and drawings but also to one who has an opportunity to experience an embodiment of the instant invention for a needle sizing structure and method. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In carrying forth the aforementioned objects, a basic embodiment of the present invention for a knitting needle sizing structure for enabling a determination of a diametrical size of a knitting needle comprises a plurality of knitting needle sizing wands and a means for retaining the sizing wands. Each of the sizing wands can comprise a sizing member, such as a sizing ring, with a sizing aperture. Each sizing aperture can have a measuring size corresponding to a knitting needle diametrical size. With this, the size of a knitting needle can be determined by a comparison of the diametrical size of the knitting needle relative to the sizing aperture of a sizing member of one of the plurality of knitting needle sizing wands.

Each knitting needle sizing wand can further include a retaining bar with a proximal end and a distal end, and the sizing ring of each knitting needle sizing wand can be coupled to the distal end of the retaining bar. The means for retaining the plurality of knitting needle sizing wands can take the form of a retaining spindle comprising a rod with a first stop member coupled to the first end thereof and a second stop member coupled to the second end thereof. Each knitting needle sizing wand can have a spindle aperture adjacent to the proximal end thereof, and the rod can be received through the spindle aperture of each of the knitting needle sizing wands.

To ensure that the knitting needle sizing wands are securely retained, the first and second stop members can have cross sectional dimensions greater than a diametrical size of the spindle apertures in the retaining bars of the knitting needle sizing wands. One or both stop members can be removably and replaceably coupled to the rod to enable, if necessary, a removal and replacement of one or more knitting needle sizing wands. In any case, the knitting needle sizing structure can additionally incorporate a rigid panel member retained on the rod of the retaining spindle for providing protection to the knitting needle sizing wands and, if desired, for providing identifying information or the like.

The sizing apertures of the knitting needle sizing wands can have unique sizes relative to one another and can progressively vary in size. The sizing apertures can be crafted pursuant to any sizing convention, whether under the US sizing convention, the Metric sizing convention, or any other sizing convention or combination thereof. In one embodiment, seventeen knitting needle sizing wands can be provided with sizing apertures ranging from US needle size 0 to US needle size 17.

To facilitate the determination of needle size, a sizing legend can be associated with each knitting needle sizing wand, such as by being molded, engraved, or otherwise formed on the retaining bar of each sizing wand. In certain embodiments, the sizing legend can be provided under the US sizing convention and in the equivalent size under the Metric sizing convention.

One taking advantage of an embodiment of the knitting needle sizing structure can simply compare the diametrical size of the knitting needle to the sizing aperture of the sizing ring of one or more of the knitting needle sizing wands until a sizing correspondence is found. With that, the user can know that the knitting needle is the size indicated by the sizing legend provided on the knitting needle sizing wand.

It will be appreciated that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

As is the case with many inventions, the knitting needle sizing structure and method disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
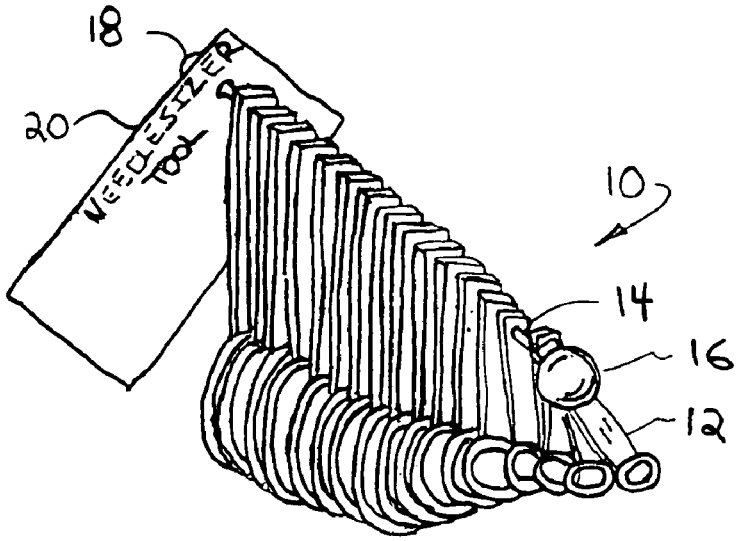
FIG. 1 is a perspective view of a knitting needle sizing structure according to the present invention.

Looking more particularly to the drawings, an embodiment of a knitting needle sizing structure according to the present invention is indicated generally at 10 in FIG. 1. There, the knitting needle sizing structure 10 can be seen to incorporate a plurality of knitting needle sizing wands 12. In the embodiment of FIG. 1, a spindle 14 acts as a means for retaining the plurality of knitting needle sizing wands 12. The knitting needle sizing wands 12 can be individually laterally pivotal and possibly rotatable relative to the spindle 14 such that the knitting needle sizing wands 12 can be operated independently.

Also retained relative to the retaining spindle 14 is a panel member 20. The panel member 20 can be crafted from a rigid material and can provide protection to the knitting needle sizing wands 12 and the knitting needle sizing structure 10 in general. Advantageously, the panel member 20 can additionally be employed to provide identifying information relative to the knitting needle sizing structure 10 itself and, additionally or alternatively, relative to the owner of the knitting needle sizing structure 10. Such an identifying function can be considered particularly useful where the knitting needle sizing structure 10 is crafted from a precious metal and also where the knitting needle sizing structure 10 has sentimental value or otherwise has particular value to the owner.

The components of the knitting needle sizing structure 10, including the knitting needle sizing wands 12, the retaining spindle 14, and the panel member 20 can be crafted of numerous different materials or combinations of within the scope of the present invention. For example, embodiments of the knitting needle sizing structure 10 can be formed from plastic while other embodiments of the knitting needle sizing structure 10 could be crafted from any one of a variety of metals, including precious metals. Still other embodiments of the knitting needle sizing structure 10 could be formed from wood. As such, it will be clear that knitting needle sizing structures 10 could be created under any appropriate method or combination of methods including molding, carving, stamping, and any other of the many procedures that would be obvious to one skilled in the art after reading this disclosure.

Figure 2:
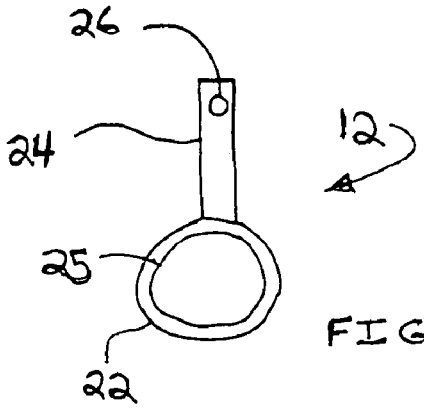
FIG. 2 is a top plan view of a sizing wand forming a portion of the knitting needle sizing structure of FIG. 1.
Figure 3:
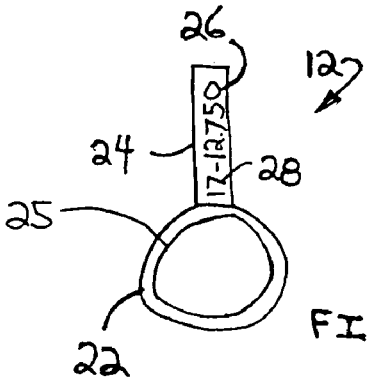
FIG. 3 is a bottom plan view of the sizing wand of FIG. 2.

One of the plurality of knitting needle sizing wands 12 is shown detached from the knitting needle sizing structure 10 in general in FIGS. 2 and 3. More particularly, the knitting needle sizing wand 12 is shown first in top plan view in FIG. 2 and then in an obverse bottom plan view in FIG. 3. Each knitting needle sizing wand 12 has a retaining bar 24 with a proximal end and a distal end. A sizing ring 22 is fixed relative to the distal end of each retaining bar 24. Each sizing ring 22 defines a sizing aperture 25 that is substantially round. A spindle aperture 26 is disposed in each retaining bar 24 adjacent to the proximal end thereof. With this, the spindle 14 can pass through the spindle apertures 26 of each of a plurality of knitting needle sizing wands 12 to retain the same in an independently operable manner.

Figure 4:
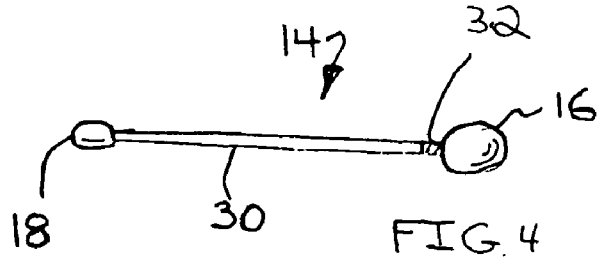
FIG. 4 is a view in side elevation of a retaining spindle forming a portion of the knitting needle sizing structure of FIG. 1.

In FIG. 4, a spindle 14 according to the present invention is shown alone. The spindle 14 has a rod 30 with a first end and a second end. A first stop member 16 is disposed at the first end of the spindle 14, and a second stop member 18 is disposed at the second end of the spindle 14. The sizes and shapes of the first and second stop members 16 and 18 certainly could vary. In this exemplary embodiment, the first stop member 16 is generally spherical and is substantially larger in effective diameter than the second stop member 18, which is generally egg shaped. The larger, spherical first stop member 16 can be used in holding and manipulating the knitting needle sizing structure 10. Each of the first and second stop members 16 and 18 preferably will have an effective diameter sufficiently larger than the diameters of the spindle apertures 26 of the knitting needle sizing wands 12 thereby to prevent the knitting needle sizing wands 12 from passing beyond either stop member 16 and 18.

The first and second stop members 16 and 18 could be fixed relative to the rod 30, such as by adhesive, by a compression fitting, by welding, by being integrally formed therewith, or by any other effective method. Alternatively, either or both stop members 16 or 18 could be removably and replaceably coupled to the rod 30 to enable, by way of example, an addition, subtraction, or removal and replacement of the knitting needle sizing wands 12. Such a removable and replaceable coupling could be accomplished in any suitable manner. For example, in the embodiment of FIG. 4, the first stop member 16 is coupled to the rod 30 by a threaded engagement 32 therewith.

Figure 6:
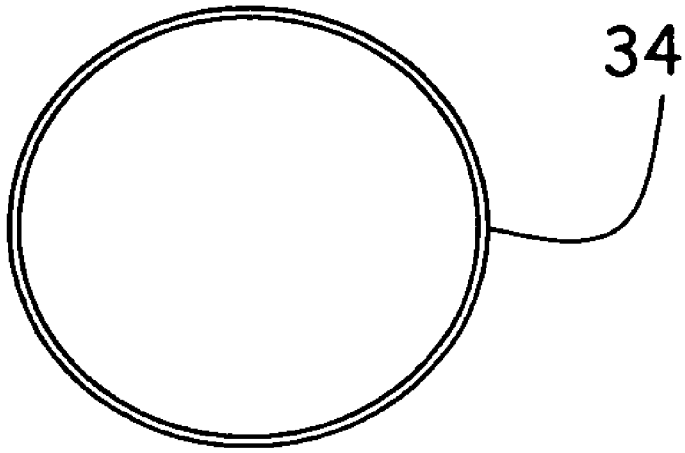
FIG. 6 is a top plan view of an alternative arrangement for retaining knitting needle sizing wands.
Figure 7:
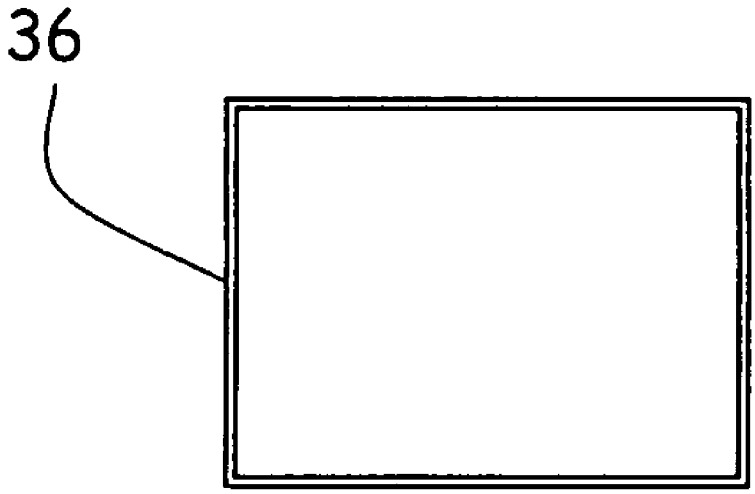
FIG. 7 is a top plan view of another arrangement for retaining knitting needle sizing wands.

Other means for retaining the knitting needle sizing wands 12 are certainly possible within the scope of the present invention. For example, as FIG. 6 shows, the means for retaining the knitting needle sizing wands 12 could take the form of a ring 34. The ring 34 could be endless. Alternatively, the ring 34 could be coiled, separable, or otherwise provided with a means for enabling the addition and subtraction of knitting needle sizing wands 12. Another means for retaining the knitting needle sizing wands 12 is shown in FIG. 7. There, a rectangular structure 36 is provided. Again, the rectangular structure 36 could be solid or it could incorporate a separable portion or any other means for enabling the addition and subtraction of knitting needle sizing wands 12.

Of course, the means for retaining the knitting needle sizing wands 12, whether it be a spindle 14 or any other means, could retain substantially any number of knitting needle sizing wands 12. The sizing apertures 25 and sizing rings 22 of the knitting needle sizing wands 12 can be uniquely sized relative to one another. For example, the sizing apertures 25 and sizing rings 22 can progressively change in size, increasing or decreasing in diameter depending on the order in which they are taken. In one presently preferred embodiment, for example, seventeen knitting needle sizing wands 12 are disposed on the spindle 14 with each knitting needle sizing wand 12 having a uniquely sized sizing aperture 25 defined by the sizing ring 22 thereof. The sizing rings 22 and sizing apertures 25 of the knitting needle sizing wands 12 have apertures ranging from US size 0 to US size 17. The US sizes roughly correspond to metric sizes 2 mm to 12 mm. More particularly, the knitting needle sizing wands 12 can have sizing rings 22 with sizing apertures 25 progressing as set forth in Chart 1: Knitting Convention Size Equivalents.

Of course, numerous other embodiments with fewer, more, or alternative sizes are possible and within the scope of the present invention. For example, other embodiments could have sizing rings 22 with sizing apertures 25 ranging from US size 000 to US size 50 with intermediate US sizes of 00, 0, 1, 2, 3, 4, 5, 6, 7, 8, 9, 10, 10.5, 10.75, 11, 13, 15, 17, 19 (16 mm), and 35(19 mm).

As FIG. 3 shows, each knitting needle sizing wand 12 can bear a sizing legend 28. The sizing legend 28 can be disposed substantially anywhere and in any manner on the knitting needle sizing wand 12. The sizing legend 28 could be molded, engraved, or otherwise created on each knitting needle sizing wand 12. In the present example, the sizing legend 28 is disposed on the retaining bar 24 of each knitting needle sizing wand 12 by being molded integrally therewith. In each case, the sizing legend 28 is provided in the US sizing convention and in the equivalent size under the Metric sizing convention. Sizes under other sizing conventions could additionally or alternatively be provided within the scope of the invention.

Figure 5:
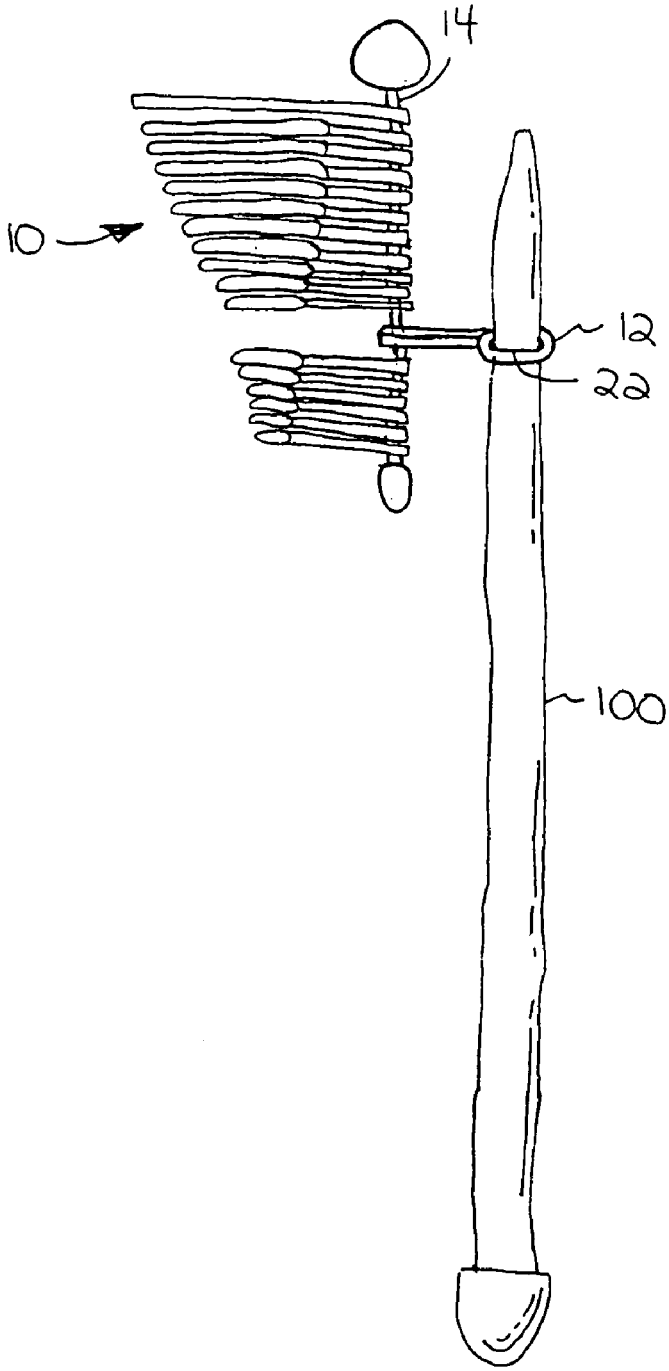
FIG. 5 is a view in side elevation of a knitting needle sizing structure pursuant to the present invention employed in the measurement of a size of a typical knitting needle.

One seeking to determine the size of a knitting needle 100 can employ an embodiment of the present invention for a knitting needle sizing structure 10 as is suggested in FIG. 5. The knitter could, by way of example, first choose a knitting needle sizing wand 12 with a sizing ring 22 having a sizing aperture 25 that the knitter believes corresponds to the size of the knitting needle 100. The sizing ring 22 can then be slipped over the tip of the knitting needle 100, and the knitter can attempt to pass the sizing ring 22 over the body portion of the knitting needle 100. If the sizing ring 22 does not fit over the body portion of the knitting needle 100, then the knitter will know to choose a knitting needle sizing wand 12 with a larger sizing ring 22. If the sizing ring 22 fits over the body portion of the knitting needle 100 but there is a looseness between the sizing ring 22 and the knitting needle 100, then the knitter will know to choose a knitting needle sizing wand 12 with a smaller sizing ring 22. If necessary, the knitter can adjust his or her size selection until a knitting needle sizing wand 12 is located that fits over the body portion of the knitting needle 100 with substantially no play between the sizing ring 22 and the knitting needle 100. The knitting needle sizing wand 12 with such a fit will represent the size of the knitting needle 100, and the knitter need only read the sizing legend 28 in the appropriate sizing convention.

The knitting needle sizing structure 10 can thus be employed to determine the exact size of a knitting needle 100 that is unmarked or that is marked in a different sizing convention than the knitter wishes to know. The knitting needle sizing structure 10 can be used relative to knitting needles 100 of any material, whether it be metal, wood, bamboo, plastic, or any other material or combination thereof, and relative to substantially any type of knitting needle 100 including straight needles, double point needles, circular needles, and any other needle type that might now exist or hereafter be developed.

CHART 1

Knitting Convention Size Equivalents

| US | 0 | 1 | | 2 | | 3 | 4 | 5 | 6 | 7 | 8 | 9 | 10 | 10.5 | 10.75 | | 11 | 13 | 15 | 17 |
|---|---|---|---|---|---|---|---|---|---|---|---|---|---|---|---|---|---|---|---|---|
| Metric | 2 | 2.25 | 2.50 | 2.75 | 3 | 3.25 | 3.5 | 3.75 | 4 | 4.5 | 5 | 5.5 | 6 | 6.5 | 7 | 7.5 | 8 | 9 | 10 | 12 |

With a plurality of exemplary embodiments and details of the present invention for a knitting needle sizing structure and method disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof.

The invention claimed is:

1. A knitting needle sizing structure for enabling a determination of a diametrical size of a knitting needle, the knitting needle sizing structure comprising:

a plurality of knitting needle sizing wands; and a means for retaining the plurality of knitting needle sizing wands;

wherein each of the plurality of knitting needle sizing wands comprises a sizing member with a sizing aperture and wherein the sizing aperture of each sizing member has a measuring size corresponding to a knitting needle diametrical size wherein the sizing member of each knitting needle sizing wand comprises a single sizing ring and wherein the sizing aperture is defined by the sizing ring and wherein each knitting needle sizing wand further comprises a retaining bar with a proximal end and a distal end wherein the sizing ring of each knitting needle sizing wand is coupled to the distal end of the retaining bar;

whereby the size of a knitting needle can be determined by a comparison of the diametrical size of the knitting needle relative to the sizing aperture of a sizing member of one of the plurality of knitting needle sizing wands.

2. The knitting needle sizing structure of claim 1 wherein the means for retaining the plurality of knitting needle sizing wands comprises a retaining spindle comprising a rod with a first end and a second end and wherein each retaining bar has a spindle aperture for receiving the spindle therethrough.

3. The knitting needle sizing structure of claim 2 further comprising a first stop member coupled to the first end of the rod of the retaining spindle and a second stop member coupled to the second end of the rod of the stop member wherein the first and second stop members have cross sectional dimensions greater than a diametrical size of the spindle apertures in the retaining bars of the knitting needle sizing wands.

4. The knitting needle sizing structure of claim 3 wherein the first stop member is removably and replaceably coupled to the rod.

5. The knitting needle sizing structure of claim 1 further comprising a rigid panel member retained by the means for retaining the plurality of knitting needle sizing wands.

6. The knitting needle sizing structure of claim 1 wherein the sizing apertures of the knitting needle sizing wands are uniquely sized relative to one another.

7. The knitting needle sizing structure of claim 6 wherein the sizing apertures of the knitting needle sizing wands have apertures ranging from at least US needle size 0 to at least US needle size 17.

8. The knitting needle sizing structure of claim 7 wherein the knitting needle sizing wands have sizing apertures corresponding at least to US needles sizes 0, 1, 2, 3, 4, 5, 6, 7, 8, 9, 10, 10.5, 10.75 11, 13, 15, and 17.

9. The knitting needle sizing structure of claim 6 further comprising a sizing legend associated with each knitting needle sizing wand.

10. The knitting needle sizing structure of claim 9 wherein the sizing legend associated with each knitting needle sizing wand is in the US sizing convention and in the equivalent size under the Metric sizing convention.

11. A method for determining a diametrical size of a knitting needle, the method comprising the steps of:

providing a knitting needle sizing structure comprising a plurality of knitting needle sizing wands and a means for retaining the plurality of knitting needle sizing wands wherein each of the plurality of knitting needle sizing wands comprises a sizing member with a sizing aperture and wherein the sizing aperture of each sizing member has a measuring size corresponding to a knitting needle diametrical size wherein the sizing member of each knitting needle sizing wand comprises a single sizing ring wherein the sizing aperture is defined by the sizing ring and wherein each knitting needle sizing wand further comprises a retaining bar with a proximal end and a distal end wherein the sizing ring of each knitting needle sizing wand is coupled to the distal end of the retaining bar;

providing a knitting needle whose size is to be determined;

comparing the diametrical size of the knitting needle to the sizing aperture of a sizing member of at least one of the plurality of knitting needle sizing wands.

12. The method of claim 11 wherein the means for retaining the plurality of knitting needle sizing wands comprises a retaining spindle comprising a rod with a first end and a second end and a first stop member coupled to the first end of the rod of the retaining spindle and a second stop member coupled to the second end of the rod of the stop member and wherein each retaining bar has a spindle aperture for receiving the spindle therethrough.

13. The method of claim 11 further comprising a rigid panel member retained by the means for retaining the plurality of knitting needle sizing wands.

14. The method of claim 11 wherein the sizing apertures of the knitting needle sizing wands are uniquely sized relative to one another.

15. The method of claim 14 wherein the sizing apertures of the knitting needle sizing wands have apertures ranging from US needle size 0 to US needle size 17.

16. The method of claim 11 further comprising a sizing legend associated with each knitting needle sizing wand and further comprising the step of reading the sizing legend of the knitting needle sizing wand that corresponds in size to the diametrical size of the knitting needle.

17. The method of claim 11 wherein the step of comparing the diametrical size of the knitting needle to the sizing aperture of the sizing member of at least one of the plurality of knitting needle sizing wands comprises comparing the diametrical size of the knitting needle to the sizing aperture of the sizing members of knitting needle sizing wands until a knitting needle sizing wand is identified with a sizing aperture corresponding in size to the diametrical size of the knitting needle.

* * * * *